US008127657B2

(12) United States Patent
Gorali et al.

(10) Patent No.: US 8,127,657 B2
(45) Date of Patent: Mar. 6, 2012

(54) ELECTRIC SAFETY DEVICE ACTUATOR

(75) Inventors: Giora Gorali, Haifa (IL); Moshe Oz, Naharia (IL); Nativ Shahak, Gesher Haziv (IL)

(73) Assignee: Rafael-Armamen-Defence Systems Ltd, Haifa (IL)

( * ) Notice: Subject to any disclaimer, the term of this patent is extended or adjusted under 35 U.S.C. 154(b) by 136 days.

(21) Appl. No.: 12/302,894

(22) PCT Filed: May 31, 2007

(86) PCT No.: PCT/IL2007/000660

§ 371 (c)(1), (2), (4) Date: Dec. 1, 2008

(87) PCT Pub. No.: WO2007/138594

PCT Pub. Date: Dec. 6, 2007

(65) Prior Publication Data

US 2009/0205237 A1 Aug. 20, 2009

(30) Foreign Application Priority Data

May 31, 2006 (IL) ..... 176038

(51) Int. Cl.
*F41A 19/06* (2006.01)

(52) U.S. Cl. ..... 89/27.12; 89/144; 89/148; 89/150; 42/70.04; 42/70.05; 42/70.06

(58) Field of Classification Search ..... 42/70.04, 42/70.05, 70.06; 89/27.12, 144, 148, 150, 89/154

See application file for complete search history.

(56) References Cited

U.S. PATENT DOCUMENTS

| | | | | |
|---|---|---|---|---|
| 5,953,844 | A * | 9/1999 | Harling et al. | 42/70.06 |
| 6,219,952 | B1 * | 4/2001 | Mossberg et al. | 42/70.01 |
| 6,253,480 | B1 * | 7/2001 | Florez | 42/70.11 |
| 6,282,829 | B1 * | 9/2001 | Mossberg et al. | 42/70.11 |
| 6,301,815 | B1 * | 10/2001 | Sliwa | 42/70.01 |
| 6,343,429 | B1 * | 2/2002 | Mossberg et al. | 42/70.01 |
| 6,785,995 | B2 * | 9/2004 | Herzog et al. | 42/70.07 |
| 7,030,729 | B2 * | 4/2006 | Albanesi et al. | 340/5.61 |

* cited by examiner

*Primary Examiner* — Michael David

(57) ABSTRACT

A safety selector for selectively implementing a firing disabled position for the prevention of unintentional firing of a firearm. The safety selector comprises two prongs adapted to push a cross bolt safety actuation lever to the right or to the left. A DC electrical motor provides torque, which is transferred through a torque transferring mechanism, to the safety selector. The safety selector is particularly useful for actuation via remote control.

3 Claims, 2 Drawing Sheets

ELECTRIC SAFETY DEVICE ACTUATOR

CROSS-REFERENCE TO RELATED APPLICATIONS

The current application is a U.S. National Phase Application under 35 U.S.C. 371 of PCT International Application No. PCT/IL2007/000660, which has an international filing date of May 31, 2007, and which claims the benefit of priority from Israel Patent Application No. 176,038, filed May 31, 2006, the disclosures of which applications are incorporated herein by reference.

FIELD OF THE INVENTION

The present invention relates to a safety mechanism for a firearm, in particular, control thereof.

BACKGROUND OF THE INVENTION

Most firearms employ a safety mechanism, also known as a "safety" that prevents unintentional firing. In some firearms, the safety is actuated by an actuation bar that is shifted sideways. The FN MAG 58 machine gun is an example of such a firearm, wherein pushing the cross bolt safety lever to the right disables the firing. Moving the lever to the left disengages the safety catch, thereby removing restraints from the trigger.

U.S. Pat. No. 6,253,480 (Florez) discloses a personalized safety device for preventing unauthorized use of a hand held weapon having a trigger. The device includes a housing which is coupled to the weapon such that the housing is positioned in front of the handgrip and trigger of the weapon. A pair of elongate guard plates outwardly extend from a pair of elongate slots in the back of the housing. A motor is disposed in the housing for extending and the retracting the guard plates from the housing. A computer is provided for controlling the retraction and extension of the guard plates by the motor. A scanner is mounted to the handgrip of the weapon and is in communication with the computer. The scanner obtains an image of the fingerprints and handprint of the user grasping the handgrip. If the scanned image matches data stored in the computer corresponding to the fingerprints and handprint of an authorized user, the computer activates the motor to retract the guard plates. The patent device does not directly actuate a trigger safety to allow firing of the weapon.

SUMMARY OF THE INVENTION

According to one aspect, the present invention provides an actuator for a firearm safety mechanism for selectively implementing a firing disabled position for the prevention of unintentional firing of a firearm and a firing enabled position, said firearm having an over-center toggle mechanism for urging said safety mechanism to either an extreme left or right position, one position being associated with firing enablement and said other position is associated with firing disablement, said actuator comprising: two prongs for alternatively pushing a cross bolt safety actuation lever, to the right or to the left; a DC electrical motor, and a torque transferring mechanism, for transferring torque from said motor to said prongs.

According to another aspect, the present invention provides a method for disabling firing of a firearm having a cross bolt safety device with a cross bolt bar, comprising supplying DC power to an electrical motor for actuating a safety selector, by transferring torque to said selector, in order to push a cross bolt bar to either a firing disabling or enabling position. According to some embodiments, the supplying or DC power is performed remotely.

DESCRIPTION OF EMBODIMENTS OF THE PRESENT INVENTION

In most hand guns and machine guns a safety device is available that can be put into effect to prevent unintentional firing of the firearm. In FM MAG guns the safety device may be actuated only when the gun is cocked. The safety device is put into effect by shifting what is known as cross bolt sideways in a specific direction. The cross bolt in this case shifts sideways to either of two directions.

The present invention provides an electrically operated actuator that is used for shifting sideways a cross bolt of a firearm in either direction to put into effect a safety mechanism, or to undo the safety lock to permit firing.

Figure 1A:
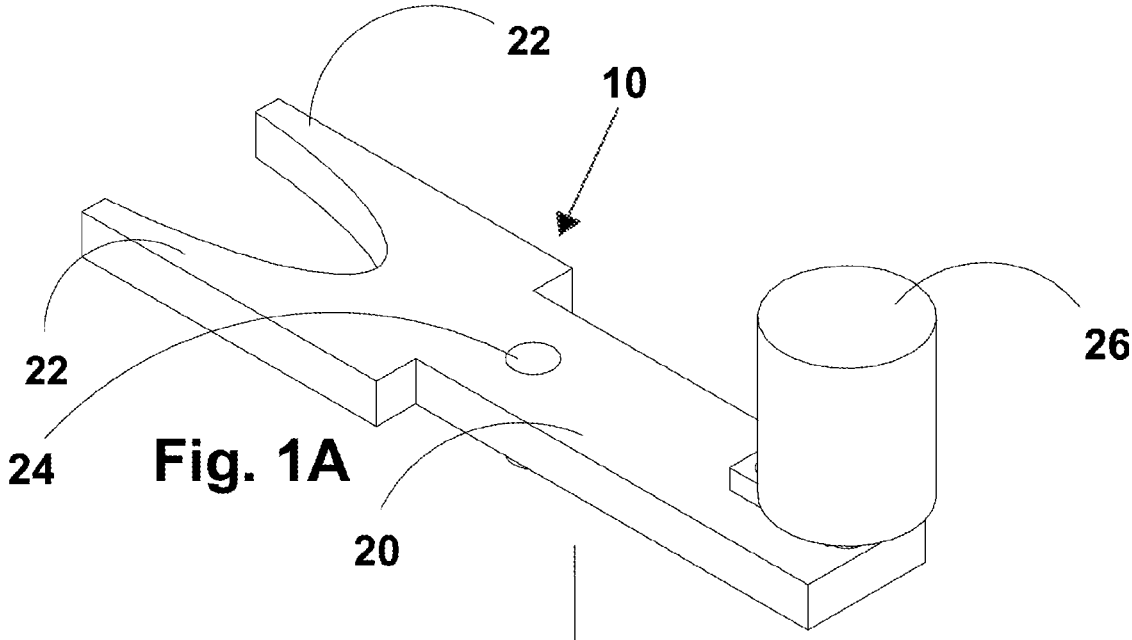
FIGS. 1A and 1B are schematic isomeric views of a safety actuator of the present invention, FIG. 1A showing the actuator with a motor and FIG. 1B showing the actuator with the motor removed for clarity.
Figure 1B:
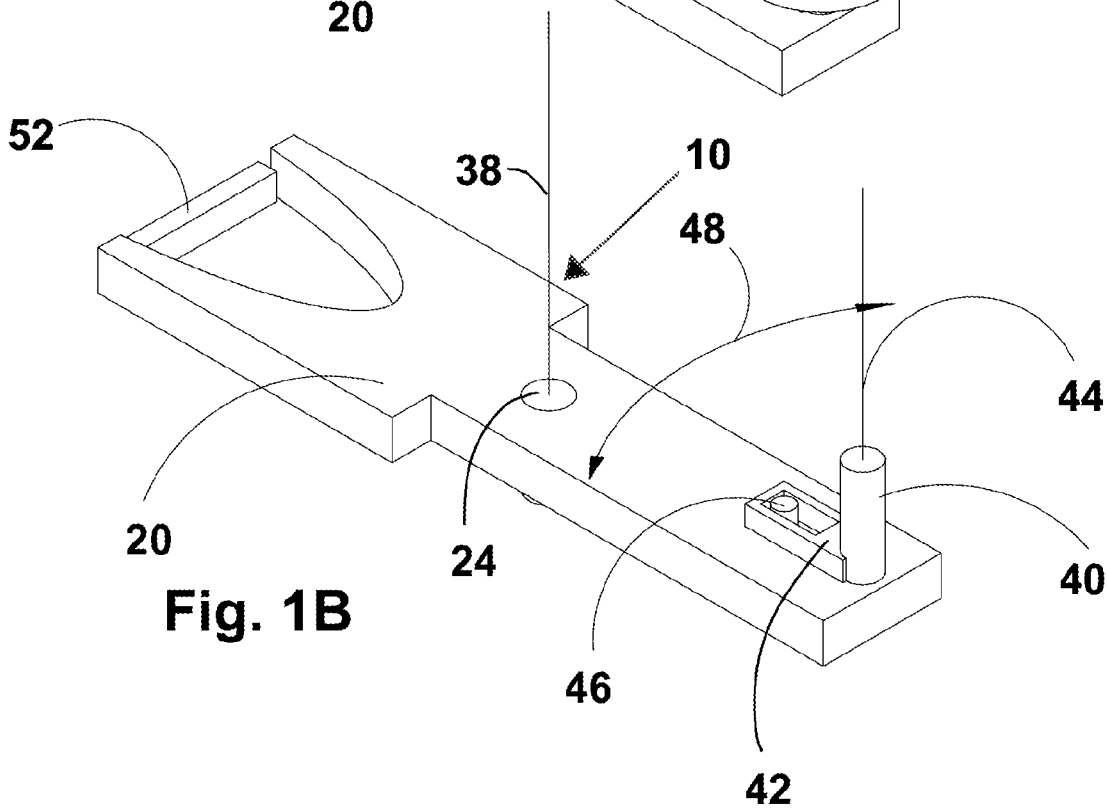

To describe an example of a preferred embodiment of the instant invention, reference is made to FIGS. 1A-1B, showing an embodiment of an actuator 10. A two-pronged fork is rotatable resulting in a sideways movement to urge the cross bolt to either a left or a right position. A safety selector 20 has two prongs 22. A vertical pivot provides for rotational movement of the fork, powered by an electric motor 26 via the motor's crankshaft 40. Axis 38 is the rotational axis provided by pivot 24. In this example, a member 42 is connected to and rotatable with crank shaft 40 about a longitudinal axis 44, urging a pin 46 to move horizontally in an arced path indicated by double headed arrow 48. Movement of pin 46 in one direction, results in a movement of prongs 22 in an opposite direction as a result of safety selector 20 pivoting about pivot 24. Bar 52 is the firearm's reciprocatable safety actuation lever that implements a selection between firing enabled and firing disabled positions.

The torque transfer mechanism from a motor to a load, exemplified by the above-indicated components of the safety selector described above, is only an example. Many other torque transferring mechanisms can be devised by a person in the art within the scope of the invention, for example, gears using toothed wheels or frictional belts, chains etc. The torque can be applied from motor 26 to any part of the safety selector as desired by good engineering practices or altered by constrains such as space limitation. Torque from the motor can also be applied to a pivot of the actuator.

As known in the art, typically of switch making, a safety selector lever is urged to assume either of two positions. Both alternative positions are typically urged by a spring, so that an intermediate position is prevented. The mechanism that implements the aforementioned action is commonly referred to as an over-center toggle mechanism.

Electrical motor 26, which actuates the safety selector, is typically a DC motor responding to polar DC input by turning in a first direction. Changing the polarity of DC supply to the motor changes the turning direction of the motor, and the output torque transferred by the motor's axis changes direction correspondingly.

The invention can be implemented in a firearm employing across bolt type safety mechanisms in which the external actuation lever is linear and shifts horizontally, as for example in the FN MAG machine gun. Actuation of the firearm by remote control, especially to autonomous remote locations is a particularly useful application of the present safety actuator.

As indicated above, the invention is especially useful in cases in which a hand gun or machine gun are autonomous and may be actuated automatically or by remote intervention of a supervisor. The safety selector of the invention can be implemented in an isolated land outpost, and also in autonomous vehicles and autonomous vessels carrying appropriately designed firearms.

Figure 2:
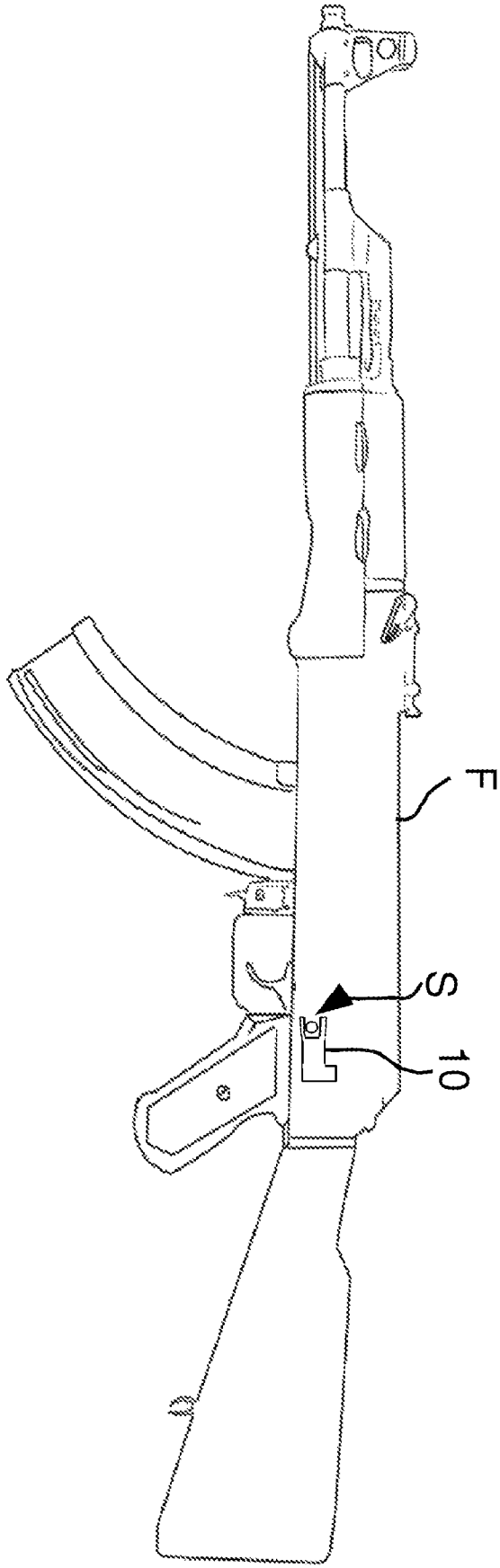
FIG. 2 is a side view of a firearm having a firearm safety mechanism ("safety") with which the actuator of the present invention can be implemented.

FIG. 2 shows actuator 10 implemented on a firearm safety mechanism S (only bar 52 of this mechanism visible) of a firearm F.

The invention claimed is:

1. An actuator configured for use with a firearm safety mechanism configured for selectively implementing a firing disabled position for the prevention of unintentional firing of a firearm and a firing enabled position, said firearm having an over-center toggle mechanism configured for urging said safety mechanism to either a first position and a second position, the first position being associated with firing enablement and the second position being associated with firing disablement, said actuator comprising:

two prongs configured for alternatively pushing a cross bolt safety actuation lever, to either of said first position and said second position;

a DC electrical motor, and a torque transferring mechanism, configured for transferring torque from said motor to said prongs, said torque transferring mechanism comprising a crankshaft and a pivot mechanism operably connected to said prongs.

2. An actuator as in claim 1 wherein said electric motor receives power supply in either polarity, wherein each polarity is associated with a different rotation direction.

3. An actuator as in claim 1, wherein said firearm is an FN MAG 58.

* * * * *